United States Patent [19]

Pratt et al.

[11] 4,198,930

[45] Apr. 22, 1980

[54] GAS SCREEN ARRANGEMENT FOR A VAPOR GENERATOR

[75] Inventors: Harry H. Pratt, West Orange, N.J.; David Cranstoun, Spring Valley, N.Y.

[73] Assignee: Foster Wheeler Energy Corporation, Livingston, N.J.

[21] Appl. No.: 904,361

[22] Filed: May 9, 1978

[51] Int. Cl.[2] ..... F22B 15/00

[52] U.S. Cl. ..... 122/235 C; 122/360; 122/478; 122/6 A

[58] Field of Search ..... 122/6 A, 235 A, 235 C, 122/478, 510

[56] References Cited

U.S. PATENT DOCUMENTS

| | | | |
|---|---|---|---|
| 1,842,235 | 1/1932 | Barnes | 122/235 |
| 1,981,865 | 11/1934 | Jones | 122/360 |
| 2,730,080 | 1/1956 | Stallkamp | 122/478 |
| 3,003,482 | 10/1961 | Hamilton et al. | 122/478 |
| 3,060,908 | 10/1962 | Brister et al. | 122/235 |
| 3,174,464 | 3/1965 | Johnson | 122/475 |
| 3,298,360 | 1/1967 | Michel | 122/510 |
| 3,400,689 | 9/1968 | Bagley et al. | 122/510 |
| 3,832,979 | 9/1974 | Ammann | 122/6 |

OTHER PUBLICATIONS

"Modern German Boiler Practice", Jul. 1964 by German Water Tube Boiler Makers Association.

*Primary Examiner*—Henry C. Yuen

*Attorney, Agent, or Firm*—Marvin A. Naigur; John E. Wilson; John J. Herguth, Jr.

[57] ABSTRACT

A vapor generator which includes an upright furnace section the boundary walls of which are formed by a plurality of tubes for passing fluid through the length of the furnace section to convert a portion of the fluid to vapor or to heat the fluid. One portion of the tubes forming one of the boundary walls are bent out of the plane of the latter wall for connection to a plurality of headers. A single tube extends upwardly from each of the headers in fluid communication with the other tubes connected to said header, with the single tubes being disposed in a spaced relationship to form a screen for the passage of combustion gases from the furnace section to a heat recovery section disposed adjacent the furnace section.

14 Claims, 8 Drawing Figures

GAS SCREEN ARRANGEMENT FOR A VAPOR GENERATOR

BACKGROUND OF THE INVENTION

This invention relates to a vapor generating system and, more particularly, to a sub-critical or super-critical once-through vapor generating system for converting water to vapor.

In general, a once-through vapor generator operates to circulate a pressurized fluid, usually water, through a vapor generating section and a superheating section to convert the water to vapor. In these arrangements, the water entering the unit makes a single pass through the circuitry and discharges through the superheating section outlet of the unit as superheated vapor for use in driving a turbine, or the like.

These arrangements provide several improvements over conventional drum-type boilers, and although some problems arose in connection with early versions of the once-through generators, such as excessive thermal losses, mismatching of steam temperature, the requirement for sophisticated controls and additional valving during startup, these problems have been virtually eliminated in later generation systems.

For example, the system disclosed in U.S. Pat. No. application Ser. No. 713,313 filed on Aug. 10, 1976, now U.S. Pat. No. 4,099,384, and assigned to the assignee of the present invention, includes a plurality of separators disposed in the main flow line between the vapor generating section and the superheating section and adapted to receive fluid flow from the vapor generating section during startup and full load operation of the system. This arrangement enables a quick and efficient startup to be achieved with a minimum of control functions, and without the need for costly valves. Also, the turbines can be smoothly loaded at optimum pressures and temperatures that can be constantly and gradually increased, without the need of boiler division valves or external bypass circuitry for steam dumping. Also, according to this system operation can be continuous at very low loads with a minimum of heat loss to the condenser.

In the latter arrangement, the walls of the furnace section of the generator are formed by a plurality of vertically extending tubes having fins extending outwardly from diametrically opposed portions thereof, with the fins of adjacent tubes being connected together to form a gas-tight structure. During startup the furnace operates at constant pressure and super-critical water is passed through the furnace boundary walls in multiple passes to gradually increase its temperature.

In this arrangement the upper portions of some of the tubes forming the rear boundary wall of the furnace section are bent out of the plane of the lateral wall and upwardly to form a gas screen for the passage of gases from the furnace section to a heat recovery area disposed adjacent the furnace section. However, this design requires precision and tedious fabrication which is difficult and time-consuming and, therefore, expensive.

SUMMARY OF THE INVENTION

It is therefore an object of the present invention to provide a vapor generator which incorporates the features of the arrangement discussed above and yet enables a gas screen to be formed in a relatively simple yet effective manner.

It is a further object of the present invention to provide a vapor generator of the above type in which a portion of the tubes forming the rear wall of the furnace section of the vapor generator are bent out of the plane of the lateral wall for connection to a plurality of headers.

It is a still further object of the present invention to provide a vapor generator of the above type in which a single tube extends upwardly from each of the headers in fluid communication with the other tubes connected to the header, with the single tubes being disposed in a spaced relationship to form a gas screen.

It is a still further object of the present invention to provide a vapor generator of the above type in which the boundary walls of the furnace section of the vapor generator are formed by a plurality of finned tubes, with the fins of adjacent tubes being interconnected to render the furnace section gas-tight.

It is a still further object of the present invention to provide a vapor generator of the above type in which the fluid passes through the boundary wall circuitry of the furnace section in one single complete pass.

Towards the fulfillment of these and other objects, the vapor generator of the present invention comprises a vapor generator comprising an upright furnace section the boundary walls of which are formed by a plurality of tubes through which fluid is passed to apply heat to the fluid. A plurality of headers are provided and are connected to the upper portions of a plurality of tubes forming one of the boundary walls. A single tube extends upwardly from each of the headers in fluid communication with the other tubes connected to said header, and are disposed in a spaced relationship to form a screen for the passage of combustion gases from the furnace section.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENT

Figure 1:
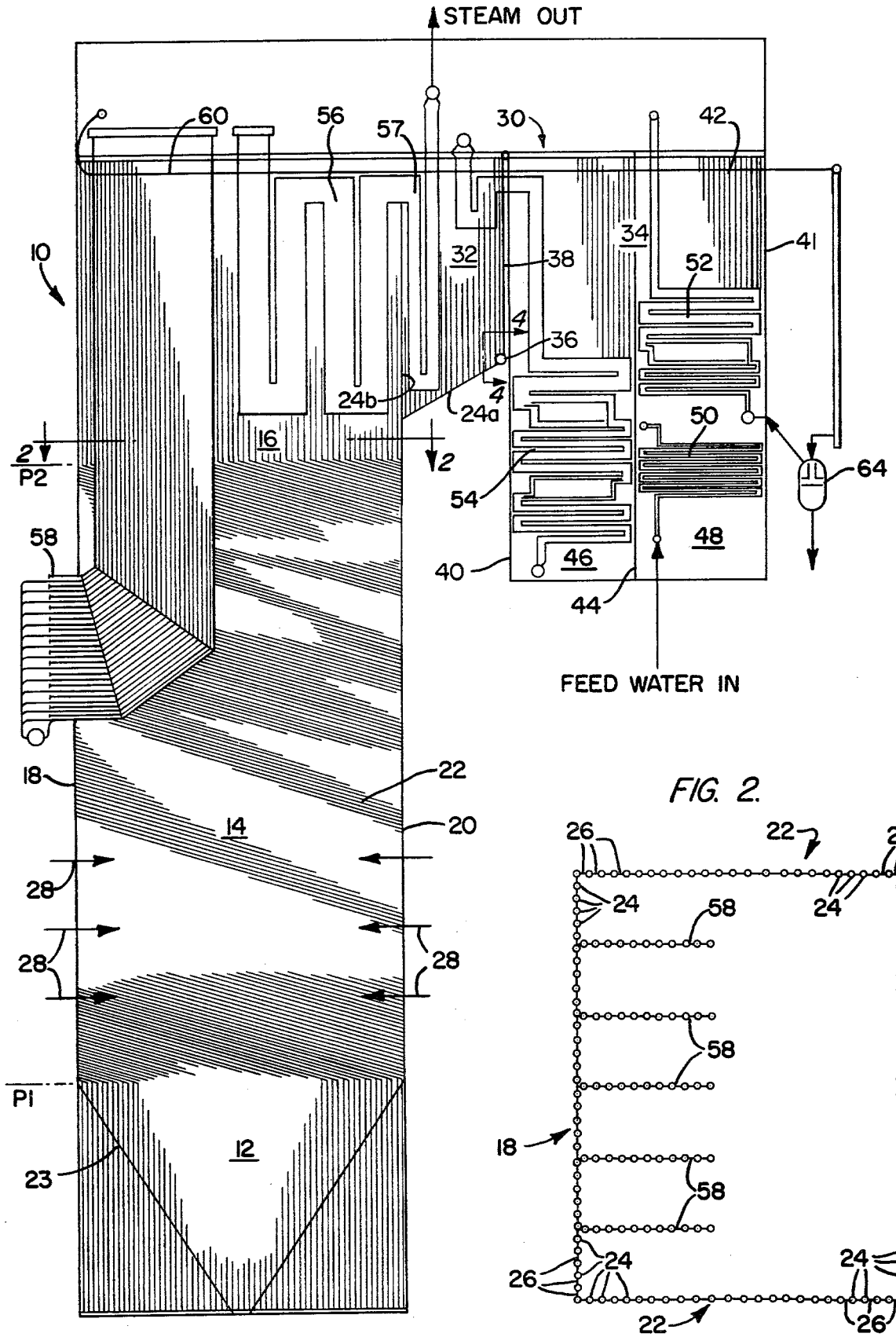
FIG. 1 is a schematic sectional view of the vapor generator of the present invention.

Referring specifically to FIG. 1 of the drawings, the reference numeral 10 refers in general to a vapor generator utilized in the system of the present invention and including a lower furnace section 12, an intermediate furnace section 14, and an upper furnace section 16. The boundary walls defining the furnace sections 12, 14, and 16 include a front wall 18, a rear wall 20 and two sidewalls extending between the front and rear wall, with one of said sidewalls being referred to by the reference numeral 22. The lower portions of the front wall 18 and the rear wall 20 are sloped inwardly to form a hopper section 23 at the lower furnace section 12 for the accumulation of ash, and the like, in a conventional manner.

Figure 2:
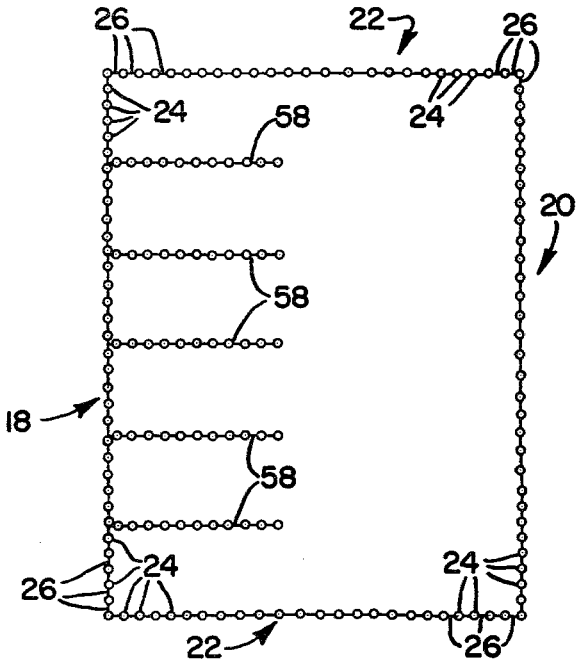
FIG. 2 is a sectional view taken along the line 2—2 of FIG. 1.

As better shown in FIG. 2, each of the walls 18, 20, and 22 are formed of a plurality of tubes 24 having continuous fins 26 extending outwardly from diametrically opposed portions thereof, with the fins of adjacent tubes being connected together in any known manner, such as by welding, to form a gas-tight structure.

Figure 3:
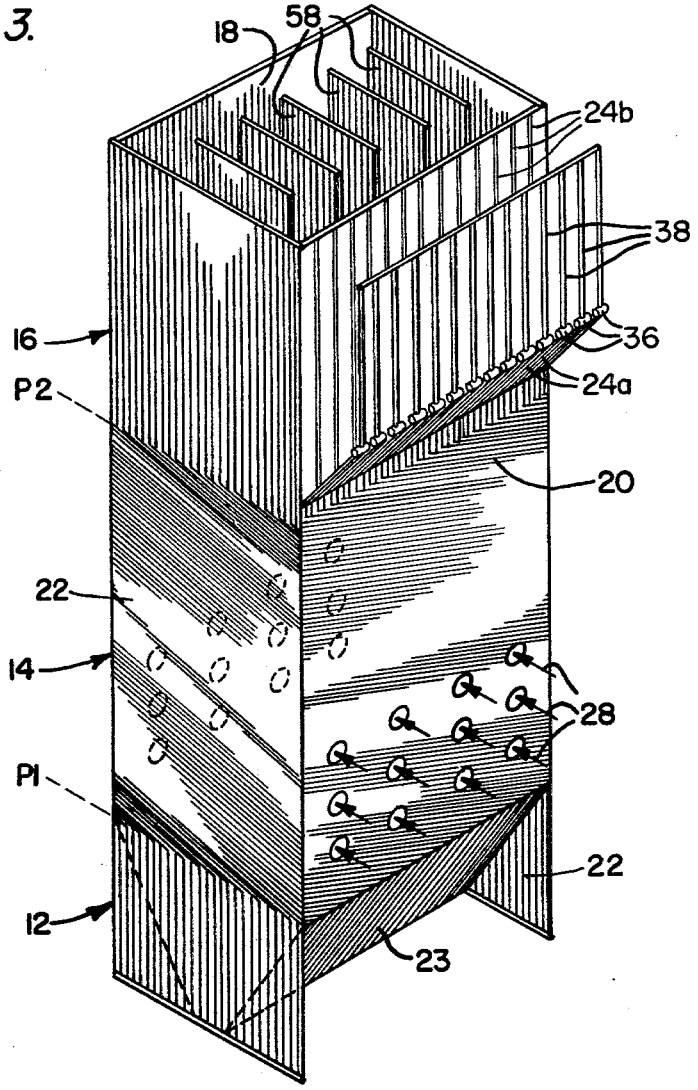
FIG. 3 is a partial perspective view of a portion of the vapor generator of FIG. 1.

Referring specifically to FIGS. 1 and 3, in the lower furnace section 12 the tubes 24 in the sidewalls 22 extend vertically up to a horizontal plane P1 located at the upper portion of the hopper section 23, while the tubes 24 in the front wall 18 and the rear wall 20 are sloped inwardly from the latter plane to form the hopper section 23. The tubes 24 forming the walls 18, 20, and 22 in the intermediate section 14 extend from the plane P1 to a plane P2 disposed in the upper portion of the vapor generator 10, with these tubes extending at an acute angle with respect to the planes P1 and P2. The tubes 24 in the intermediate section 14 wrap around for the complete perimeter of the furnace section at least one time to form the corresponding portions of the walls 18, 20, and 22 before they terminate at plane P2.

The tubes 24 forming the walls 18, 20, and 22 of the upper furnace section 16 extend vertically from the plane P2 to the top of the latter section with the exception of a portion of the tubes in the rear wall 20 which will be discussed in detail later.

Each angularly extending tube 24 in the intermediate furnace section 14 registers with two tubes 24 in the upper furnace section 16 and with two tubes 24 in the lower furnace section 12. The connection between each tube 24 in the intermediate furnace section 14 and its two corresponding tubes in the upper furnace section 16 and in the lower section 12 can be made by a plurality of bifurcate connections between the respective tubes as disclosed in detail in the U.S. application Ser. No. 791,830, filed on Apr. 28, 1977 and assigned to the same assignee as the present invention.

A plurality of burners 28 are disposed in the front and rear walls 18 and 20 in the intermediate furnace section 14, with the burners being arranged in this example in three vertical rows of four burners per row. The burners 28 are shown schematically since they can be of a conventional design.

A heat recovery area, shown in general by the reference numeral 30, is provided adjacent the upper furnace section 16 in gas flow communication therewith and includes a vestibule section 32 and a convection section 34.

As better shown with reference to FIGS. 1 and 3, portions of the tubes 24 forming the rear wall 20 of the furnace section 12 are bent outwardly as shown by the reference numeral **24*a* at an angle to the plane of the latter wall and are connected to a plurality of cylindrical headers 36 which extend in a coaxial relationship in a row extending parallel to the plane of the rear wall 20**.

Figure 4:
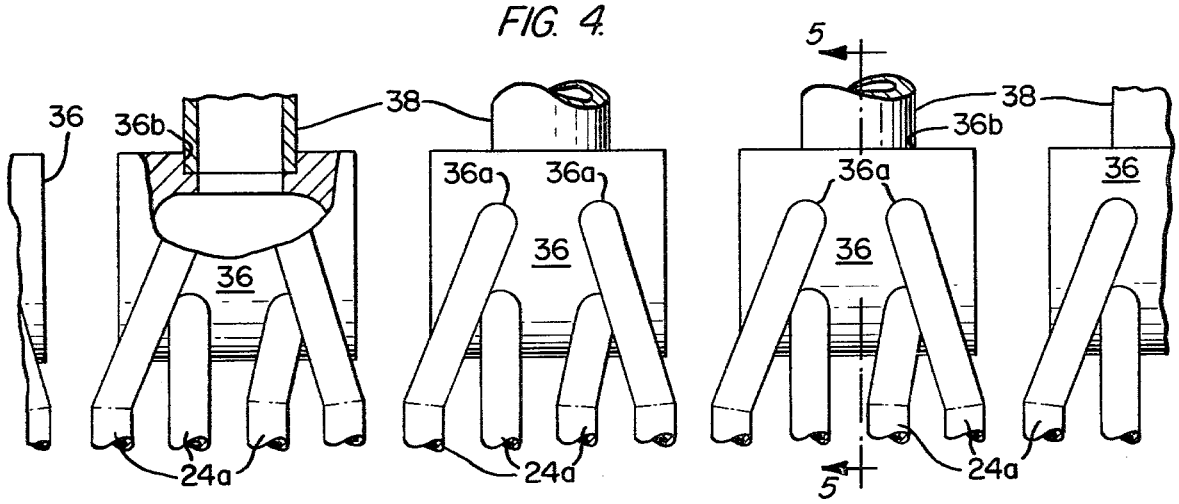
FIG. 4 is an enlarged partial cross-sectional view taken along the line 4—4 of FIG. 1.
Figure 5:
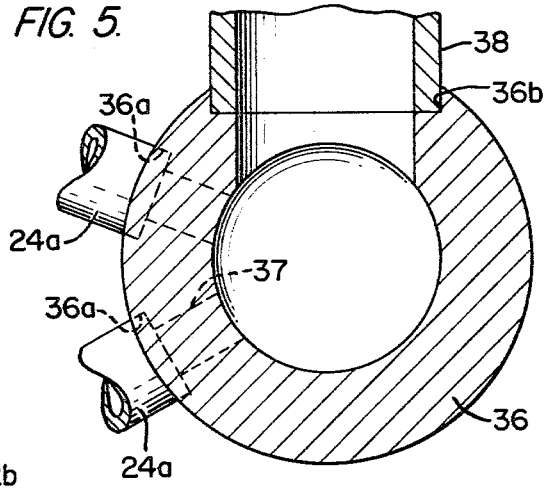
FIG. 5 is a cross-sectional view taken along the line 5—5 of FIG. 4.

A portion of the cylindrical headers 36 are depicted in detail in FIGs. 4 and 5 along with their respective connections to the tubes **24*a*. Each header 36 has two rows of two inlet counterbores which are adapted to receive the corresponding ends of four of the tubes 24*a*, with two of the latter being bent slightly as shown to register with their respective inlet counterbore. As shown in FIG. 5 each bottle 36 is hollow and each inlet counterbore 36*a* extends for a short radial distance into the wall of each bottle 36 and communicate, via a radial passage 37 formed through the latter wall, with the interior of the header. The ends of the tubes 24*a* are secured to the headers 36** in any known manner such as by welding.

It is noted that for each five consecutive vertically extending tubes 24 in the upper furnace section 16, four are bent outwardly to form the portions **24*a* while the remaining one continues upwardly vertically for connection to an upper header with the latter tube being shown by the reference numeral 24*b* in FIGS. 1 and 3. As shown in FIG. 4, the tubes 24*a* are uniformly spaced in a lateral direction and form the floor of the vestibule section 32. Although not shown in the drawings it is understood that the tube portions 24*a* have continuous fins 26 connected thereto with the fins of adjacent tubes being connected together in a manner similar to that of the tubes 24** to render the floor gas-tight.

A vertically extending tube 38 extends upwardly from each header 36 to an upper header and is welded to the header over an outlet opening **36*b* formed through the header in communication with the interior of each header to put the tube 38 in fluid communication with each of the tubes 24*a***.

The tubes 38 are of a larger diameter than the tubes 24 and extend in a spaced relation to form a gas screen for permitting the combustion gases from the upper furnace section 16 to pass through the vestibule section 32 and into the convection section 34.

The convection section 34 includes a front wall 40 the upper portion of which is formed by a plurality of tubes extending in a spaced relationship to form an additional screen adjacent the screen formed by the tubes 38. The heat recovery area 30 also includes a rear wall 41 and two sidewalls 42, with one of the latter being shown in FIG. 1. It is understood that the rear wall 41, the sidewalls 42, and the lower portions of the front wall 40 are formed of a plurality of vertically extending, finned, interconnected tubes 24 in a similar manner to that of the upper furnace section 16. Also, to insure gas tightness it is understood that a seal plate, or the like, (not shown) will extend from the area in which the tubes **24*a* are connected to the bottles 36 to the front wall 40**.

A partition wall 44, also formed by a plurality of finned interconnected tubes 24, is provided in the heat recovery area 30 to divide the latter into a front gas pass 46 and a rear gas pass 48. An economizer 50 is disposed in the lower portion of the rear gas pass 48, a primary superheater 52 is disposed immediately above the economizer, and a bank of reheater tubes 54 is provided in the front gas pass 46.

A platen superheater 56 is provided in the upper furnace section 16 and a finishing superheater 57 is provided in the vestibule section 32 in direct fluid communication with the platen superheater 56.

As better shown in FIG. 3 a plurality of division walls 58 are provided with each having a portion disposed adjacent the front wall 18. The division walls 58 penetrate a portion of the tubes 24 of the latter wall in the intermediate furnace section 14 and extend upwardly within the upper furnace section 16 as shown in FIG. 1.

The upper end portions of the tubes **24*b* and 38 as well as the walls 18, 20, and 22 of the furnace section 12, the division walls 58, and the partition wall 44, sidewalls 42 and rear wall 41 of the heat recovery area 30 all terminate in substantially the same general area in the upper portion of the vapor generating section 10**.

A roof 60 is disposed in the upper portion of the section 10 and consists of a plurality of tubes 24 having fins 26 connected in the manner described above but extending horizontally from the front wall 18 of the furnace section to the rear wall 36 of the heat recovery area 30.

It can be appreciated from the foregoing that combustion gases from the burners 28 in the intermediate furnace section 14 pass upwardly to the upper furnace section 16 and through the screens defined by the tubes **24*b* and 38 and the tubes forming the upper portion of the wall 40 and through the heat recovery area 30 before exiting from the front gas pass 46 and the rear gas pass 48. As a result, the hot gases pass over the platen superheater 56, the finishing superheater 57 and the primary superheater 52, as well as the reheater tubes 54 and the economizer 50**, to add heat to the fluid flowing through these circuits.

Although not shown in the drawings for clarity of presentation, it is understood that suitable inlet and outlet headers, downcomers and conduits, are provided to place the tubes 24 of each of the aforementioned walls and heat exchangers as well as the roof 60 and the tubes **24*a* and 38** in fluid communication to establish a flow circuit that will be described in detail later.

A plurality of separators 64 are disposed in a parallel relationship adjacent the rear wall 41 of the heat recovery area 30 are disposed directly in the main flow circuit between the roof 60 and the primary superheater 52. The separators 64 may be identical to those described in the above mentioned patent application and operate to separate the fluid from the roof 60 into a liquid and vapor. The vapor from the separators 64 is passed directly to the primary superheater 52 and the liquid is passed to a drain manifold and heat recovery circuitry for further treatment as also disclosed in the above mentioned application.

For the purposes of example, the diameter of tubes 24 in the upper furnace section 16 and the lower furnace section 12 can be $1\frac{1}{8}$ inch, the diameter of the tubes in the intermediate furnace section 14 can be $1\frac{3}{8}$ inch and the diameter of the tubes 38 can be 3 inches. Also, the angle that the tubes 24 in the intermediate furnace section extend with respect to the planes P1 and P2, can be between 20° and 25°, and in the example just described is 22°.

Figure 6:
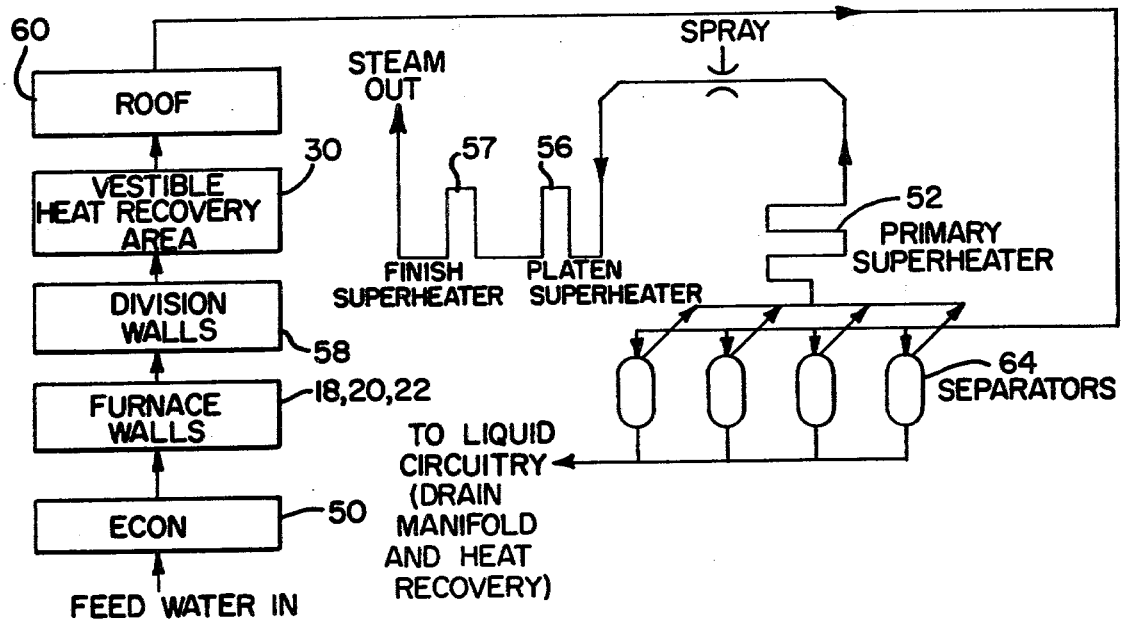
FIG. 6 is a schematic diagram depicting the flow circuit of the vapor generator of FIG. 1.

The fluid circuit including the various components, passes and sections of the vapor generating section of FIG. 1 is shown in FIG. 6. In particular, feedwater from an external source is passed through the economizer tubes 50 to raise the temperature of the water before it is passed to inlet headers (not shown) provided at the lower portions of the furnace walls 18, 20, and 22. All of the water flows upwardly and simultaneously through the walls 18, 20, and 22 and the screen formed by the tubes 38 to raise the temperature of the water further to convert at least a portion of same to vapor, before it is collected in suitable headers located at the upper portion of the vapor generator 10. The fluid is then passed downwardly through a suitable downcomer, or the like, and then upwardly through the division walls 58 to add additional heat to the fluid. The fluid is then directed through the walls 40, 41, 42, and 44 of the heat recovery area 30 after which it is collected and passed through the roof 60. From the roof 60, the fluid is passed via suitable collection headers, or the like, to the separators 64 which separate the vapor portion of the fluid from the liquid portion thereof. The liquid portion is passed from the separators to a drain manifold and heat recovery circuitry (not shown) for further treatment, and the vapor portion of the fluid in the separators 64 is passed directly into the primary superheater 52. From the latter, the fluid is spray attemperated after which it is passed to the platen superheater 56 and the finishing superheater 57 before it is passed in a dry vapor state to a turbine, or the like.

Figure 7:
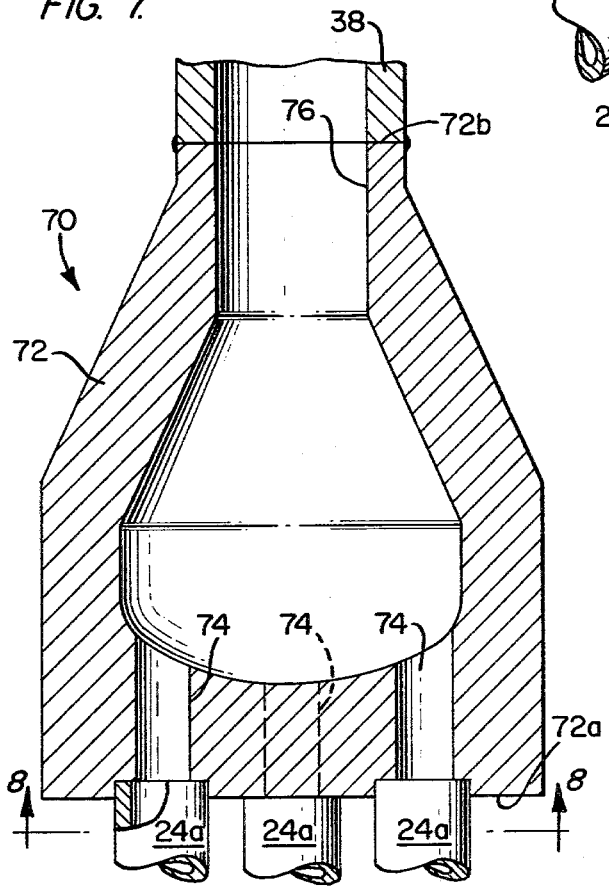
FIG. 7 is a view similar to FIG. 5 but depicting an alternate embodiment of the header utilized in the vapor generator of the present invention.
Figure 8:
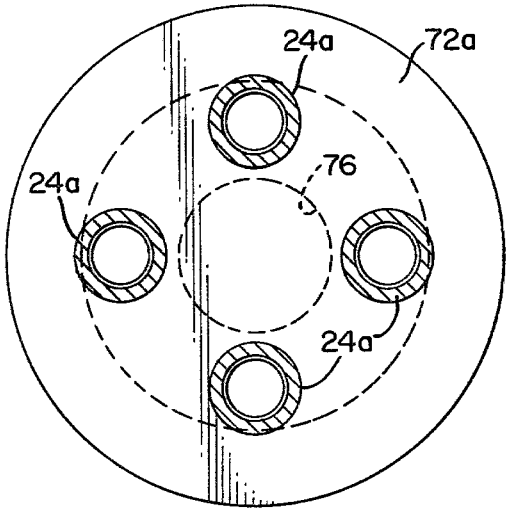
FIG. 8 is a cross-sectional view taken along the line 8—8 of FIG. 7.

FIGS. 7 and 8 depict an alternate embodiment of a header which functions in an identical manner to the header 36 of the previous embodiment. The header of the embodiment of FIGS. 7 and 8 is shown in general by the reference numeral 70 and includes a hollow body member 72 which has a circular cross section and which is tapered from an inlet end **72*a* of a relatively large diameter to an outlet end 72*b*** of a relatively small diameter.

As shown in FIG. 8, the inlet end **72*a* of the body member 72 is provided with four inlet openings disposed in an angularly spaced relationship and adapted to receive the corresponding end portions of the tubes 24*a*** in any known manner such as by welding, or the like, with the tubes being bent as necessary to align with the openings.

The hollow portion of the body member 72 is in communication with the inlet openings via a plurality of passages 74, and an outlet opening 76 is formed through the outlet end portion **72*b* of the body member 72 in communication with the hollow portion of the body member. A tube 38 is connected to the outlet end portion 72*b* in communication with the outlet 76 for receiving the fluid from the body member 72**.

As a result, fluid flow from the tubes **24*a* passes into and through the body member 72 and through the tube 38** as described in connection with the previous embodiment.

The headers 70 are located in a row and each receives four adjacent tubes **24*a* with each fifth tube 24 staying in the plane of the rear wall 20** in the same manner as discussed in connection with the previous embodiment.

It is understood that the portions of the tubes **24*a* forming the floor of the vestibule portion 32 are provided with interconnected fins and that a seal plate (not shown) extends from the area in which the tubes connect with the header 70 to the wall 40** as discussed in connection with the previous embodiment.

It is understood that while the preferred embodiments described above include a furnace having a substantially rectangular shaped cross-sectional area, other cross-sectional configurations, such as those having a circular or elliptical patterns, may be utilized. For example, the furnace may have a helical configuration in a pattern conforming to the cross-sectional shape of the furnace. (In this context, it should be noted that the type of boiler covered by the present invention in which the tubes are angularly arranged in the furnace boundary wall is commonly referred to by those skilled in the art as a "helical tube boiler," notwithstanding the fact that a true mathematical helix is not generated in a boiler which has a substantially rectangular cross-sectional area.) It is also understood that the tubes may wrap around the furnace for more than one complete revolution, depending on the overall physical dimensions of the furnace. Further the tubes forming the boundary walls of the furnace section, including those in the intermediate section described above, may extend vertically for the entire length of the wall.

It is further understood that portions of the vapor generator have been omitted for the convenience of presentation. For example, insulation and support systems can be provided that extend around the boundary walls of the vapor generator and windbox, or the like, may be provided around the burners 28 to supply air to same in a conventional manner. It is also understood that the upper end portions of the tubes 24 forming the upper furnace section 16 and the heat recovery area 30 can be hung from a location above the vapor generating section 10 to accommodate thermal expansion in a conventional manner.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A vapor generator comprising an upright furnace section the boundary walls of which are formed by a plurality of tubes and means for passing fluid through said tubes to apply heat to said fluid, a plurality of headers, each connected to the upper portions of a plurality of tubes forming one of said boundary walls, one portion of said tubes forming said one of said boundary walls being bent out of the plane of said one wall and away from the furnace section for connection to said headers and the remaining portion of said tubes extending upwardly for the height of said furnace section, and a single additional tube extending upwardly from each of said headers in fluid communication with said one portion of tubes connected to said header, said single additional tubes being disposed in a spaced relationship to form a screen for the passage of combustion gases from said furnace section.

2. The vapor generator of claim 1, wherein each of the upper portions of said one portion of tubes extends into a counterbore in a wall of a header.

3. The vapor generator claim 1, further comprising means defining a heat recovery section adjacent said furnace section.

4. The vapor generator of claim 3, wherein said headers, said single additional tubes and said one portion of tubes all extend in said heat recovery section, said screen permitting the passage of said gases from said furnace section into said heat recovery section.

5. The vapor generator of claim 1, wherein said single additional tubes are of a larger diameter than said other tubes.

6. The vapor generator of claim 1, wherein all of the tubes but one of a given group of adjacent tubes are connected to a header, with the one tube extending upwardly for the height of said furnace section.

7. The vapor generator of claim 1, wherein four out of every five of a given group of adjacent tubes are connected to a header, with the remaining tubes extending upwardly for the height of said furnace section.

8. The vapor generator of claim 1, wherein said tubes have fins extending outwardly from diametrically opposed portions thereof, with the fins of adjacent tubes being welded together to form a gas-tight structure.

9. The vapor generator of claim 1, wherein all of said fluid is passed simultaneously through the tubes of all of said boundary walls.

10. The vapor generator of claim 1, wherein said furnace section has a rectangular horizontal cross-section.

11. The vapor generator of claim 1, further comprising a superheating section, fluid separating means, and fluid flow circuitry connecting said fluid separating means in a series flow relation between said furnace section and said superheating section.

12. The vapor generator of claim 11, wherein said fluid separating section receives fluid from said vapor generating section during startup and full load operation of said system and separates said fluid into a liquid and a vapor, said fluid flow circuitry passing the vapor from said separating section to said superheating section during startup and full load operation of said system.

13. The vapor generator of claim 1, further comprising a plurality of division walls, each division wall having a portion disposed adjacent a boundary wall of the furnace section.

14. The vapor generator of claim 13, wherein the division walls penetrate said boundary wall and extend upwardly within the furnace section.

* * * * *